United States Patent [19]

Vatant

[11] Patent Number: 4,580,271

[45] Date of Patent: Apr. 1, 1986

[54] ELECTRIC ARC FURNACE EQUIPPED WITH REMOVABLE PANELS

[75] Inventor: Robert Vatant, St. Chamond, France

[73] Assignee: Clecim, Courbevoie, France

[21] Appl. No.: 653,807

[22] Filed: Sep. 24, 1984

[30] Foreign Application Priority Data

Sep. 30, 1983 [FR] France ..... 83 15590

[51] Int. Cl.[4] ..... F27D 1/12

[52] U.S. Cl. ..... 373/76

[58] Field of Search ..... 373/74, 75, 76; 110/173 R, 180; 432/237; 49/463

[56] References Cited

U.S. PATENT DOCUMENTS

| | | | |
|---|---|---|---|
| 665,484 | 1/1901 | Stoeffler | 110/173 R |
| 1,483,978 | 2/1924 | Keenan | 110/180 X |
| 2,477,161 | 7/1949 | Ausland et al. | 432/237 |
| 4,387,464 | 6/1983 | Wronka | 373/76 |

*Primary Examiner*—Roy N. Envall, Jr.

*Attorney, Agent, or Firm*—Pollock, Vande Sande & Priddy

[57] ABSTRACT

Electric arc furnace of the type comprising a bottom structure (1, 2) comprising the floor, a top structure (3) connected to the bottom structure by supporting columns (5), and cooled removable panels (6) filling the space between the two structures. Each of the removable panels and their supporting structures are provided with associated, separable hinge structures (15, 16, 17, 18) disposed on each panel and on its supporting structures in such manner that the panel can open outwards by rotation about its hinges.

5 Claims, 4 Drawing Figures

ELECTRIC ARC FURNACE EQUIPPED WITH REMOVABLE PANELS

FIELD OF THE INVENTION

The present invention relates to an electric arc furnace in which the side wall comprises removable vertical metal panels cooled by circulation of water, for example of the type described in French Pat. No. 2,445,942.

PRIOR ART

Furnaces equipped with panels of this kind generally have a circular bottom structure of metal surrounding the furnace floor of refractory material. A circular top structure of metal, which in turn carries a roof, for example one of the type described in French Pat. No. 2,476,823, is placed vertically in line with the bottom metal structure, to which it is connected by vertical spacing and supporting columns.

The vertical wall of these furnaces is then composed of a circular assembly of a fairly large number, generally about ten, of metal panels, each of which is cooled by the ciculation of water. The spacer columns are disposed outside the panels, in relation to the interior of the furnace, so as to be protected against radiation.

These conventional arrangements have the consequence that in furnaces known to date the panels cannot be removed except by extracting them through the top of the furnace, after removal of the roof, which has the disadvantage of requiring a long shutdown period.

In addition, for this removal these panels must necessarily be disconnected from the cooling water circuit and thus, while not undergoing cooling, are subjected to intensive calorific radiation originating from the floor of refractory material, and this usually increases the size of the cracks which were the reason for the removal.

SUMMARY OF THE INVENTION

The arc furnace of the invention does not have this kind of disadvantage, because with this furnace it is possible to remove the panels from the furnace without taking off the roof and without disconnecting these panels from their cooling circuit. It is a furnace in which each of these removable panels and their supporting structures are provided with associated, separable hinge and hinge pin means disposed on each panel and on its supporting structures in such a manner that the panel can be opened outwards in the manner of a door turning on its hinges.

To this end, each supporting column is associated with at least one cooled panel removably articulated on the column about an axis parallel to the latter and offset towards the outside, the column being at least partly covered towards the interior of the furnace by the corresponding side of the panel when the latter is in its closed position.

BRIEF DESCRIPTION OF THE DRAWINGS

The invention will be better understood with the aid of the following description of an exemplary embodiment, given with reference to the accompanying drawings, in which.

DETAILED DESCRIPTION

Figure 1:
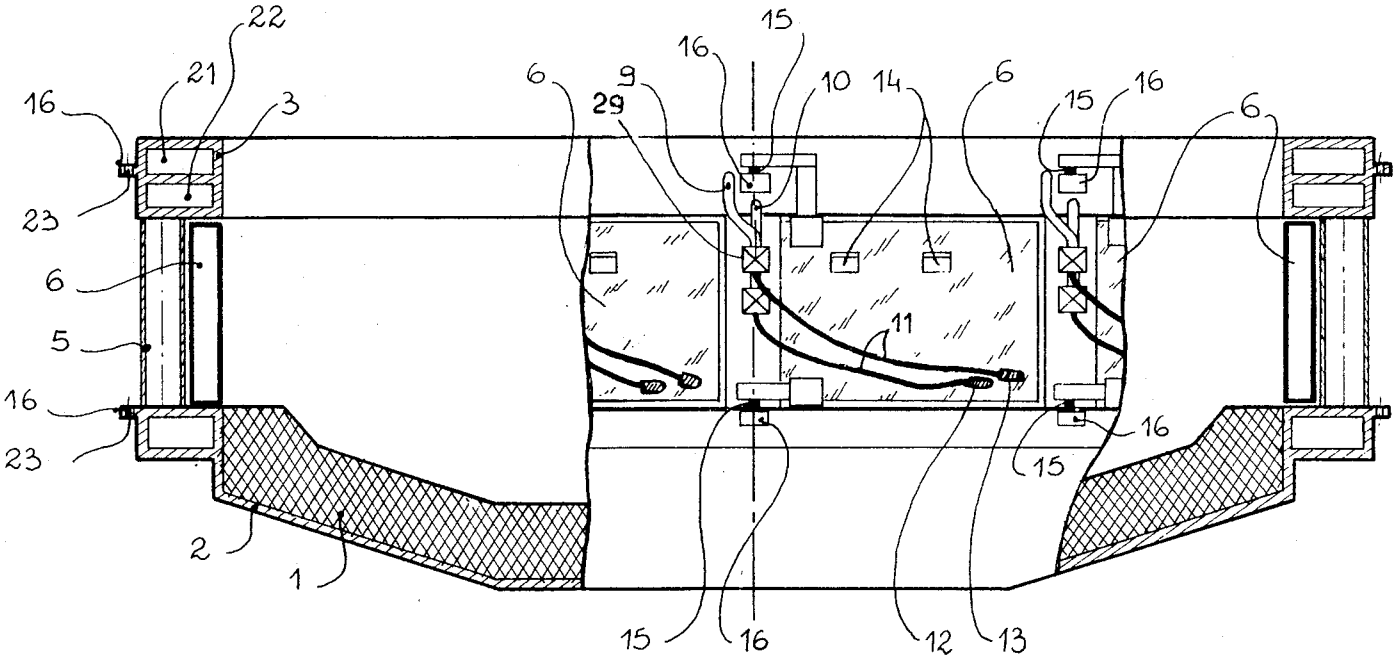
FIG. 1 is a general view of the electric furnace of the invention with the roof removed, partly in section through the axis of the furnace and partly in front elevation.
Figure 2:
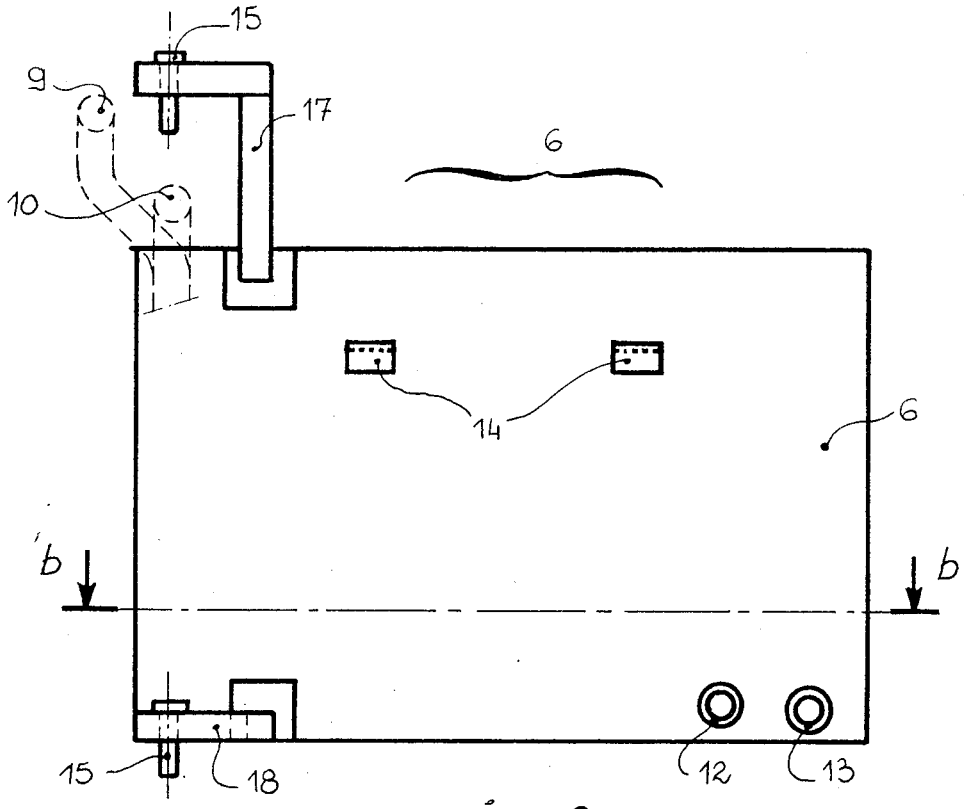
FIG. 2 is a front view of one of the removable panels with which the electric furnace shown in FIG. 1 is equipped.
Figure 3:
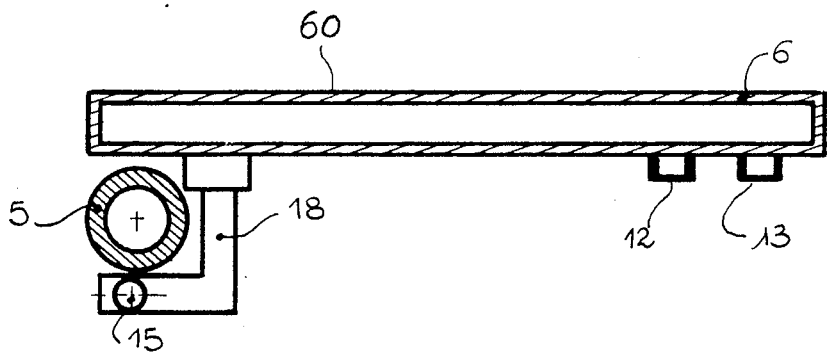
FIG. 3 is a view in section on the line b—b in FIG. 2.

Referring to FIGS. 1 to 3, the electric furnace according to the invention comprises a floor 1 of refractory material surrounded by a bottom metal structure 2, and a top metal structure 3 connected to the bottom structure 2 by columns 5 of circular section. Structure 3 is topped by a roof (not shown), and the space between the structures 2 and 3 is filled, in conventional manner, by some ten cooled metal panels 6 of a type such as that described in French Pat. No. 2,445,942.

FIG. 3, which is a section taken transversely to the axis of a column 5, shows how a panel mounted on the furnace is disposed. It can be seen that the column 5 is protected against radiation by the side 60 of the panel 6.

The top structure 3 is in the form of two tubular ducts 21, 22 of rectangular section, one of which serves to supply the panels 6 with cooling water, while the other serves to discharge this water. The water is thus supplied and discharged by means of branches 9, 10 provided with stop valves 29 and flexible hoses 11 connected by removable connectors to water inlet (12, 13) and outlet points on the panel 6.

According to the invention, each panel 6 is mounted pivoting on the furnace about aligned pivots 15 which constitute the articulation axis and which are detachably disposed in bores 23 provided in bosses 16 fastened to the furnace, as can be seen in the drawing. Each panel 6 is thus mounted on the furnace in the same way as a door is mounted on its hinges.

As can be seen in FIGS. 2 and 3, the pivots 15 are fixed to the panels 6 with the aid of support members 17, 18 fastened to the panel and forming hinge straps of bent shape, which pass around column 5 as far as the articulation axis 15, the latter being sufficiently offset outwards in relation to the column to permit free movement of the panel. Side 60 of the panel 6 which covers the column can thus be disengaged by turning the panel to enable it to be detached. The flexible hoses 11 follow the rotation of the panel and are not disconnected until the panel is in the disassembly position isolated from the furnace.

Figure 4:
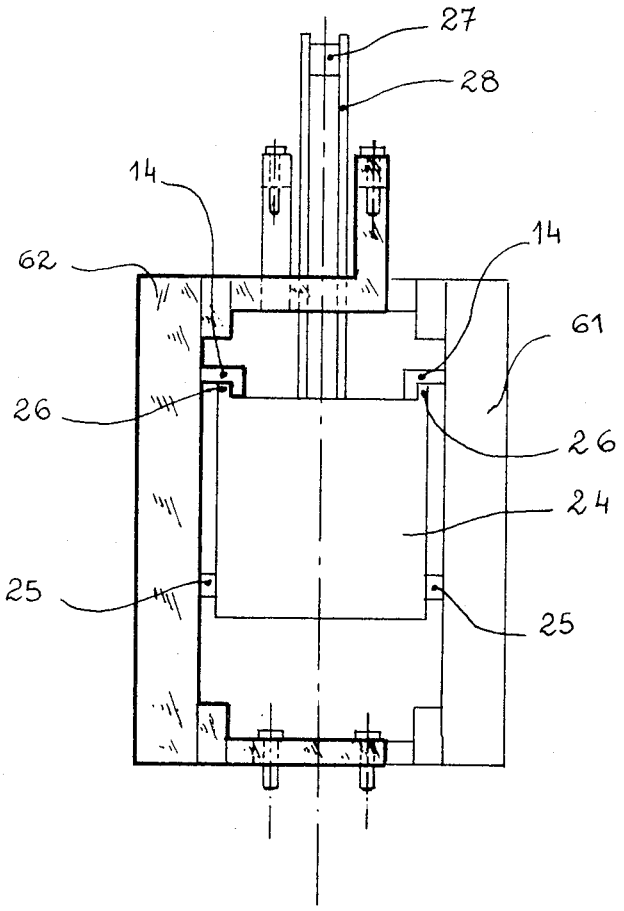
FIG. 4 is a diagrammatical representation of a tool permitting the installation and removal of the panels of the furnace of the invention.

In addition, each panel is provided with grip brackets 14 permitting the easy fitting and removal of the panel. Use is advantageously made of a special tool shown diagrammatically in FIG. 4, which enables a panel 61 to be rapidly replaced by a panel 62, while the water cooling of these two panels is maintained.

The tool in question is composed of a frame 24 provided with two symmetrical hooking assemblies comprising supports 25 for the walls of the panels 61, 62 and hooks 26 engaging in the brackets 14 for the purpose of lifting the panels. The frame 24 is handled by a traveling crane whose hook (not shown) engages with a pin 27 forming part of a grip means 28 fastened to the frame 24.

The dismantling frame 24 loaded with the replacement panel 61 is hooked to the panel 62 to be replaced, taken out of the furnace. The flexible hoses 11 are then disconnected from the panel 62 and immediately reconnected to the panel 61, which is then placed on its hinges and fitted in position by pivoting.

The embodiment described above could obviously undergo modifications relating, for example, to the shape or mounting of the panels, without departing from the scope of protection claimed. Thus, each column could carry two panels extending one on each side, each covering half of the space between columns. Similarly, other tools could be used.

I claim:

1. An electric arc furnace of the type comprising a bottom structure (1, 2) comprising a floor, a top structure (3) connected to said bottom structure by supporting columns (5), and a side wall comprising removable cooled panels (6) extending between said bottom and top structures, wherein each of said removable panels and their supporting structures are provided with associated, separable hinge and hinge pin means (15, 16, 17, 18) disposed on each said panel and on its supporting structures in such manner that said panel can be pivoted outwardly about a vertical axis by rotation about its hinges to enable its removal from said furnace.

2. Electric furnace as claimed in claim 1, wherein each supporting column (5) is associated with at least one cooled panel (6) removably articulated on said column about an axis (15) parallel to the latter and offset towards the outside, said column (5) being at least partly covered towards the interior of said furnace by a corresponding side (60) of said panel when the latter is in closed position.

3. Electric furnace as claimed in claim 2, wherein each panel (6) is provided with bent support members (18) forming hinge straps, partly surrounding the corresponding column (5) and provided with pivots (15) in alignment with the axis of articulation and adapted to engage in bores (23) provided in bosses (16) fastened to said furnace.

4. Electric furnace as claimed in claim 1, wherein each panel is connected to a cooling circuit of said furnace by flexible hoses (11) provided with stop valves (29) and removable connectors to said cooling circuit, said hoses (11) remaining connected during the pivoting of said panel to removal position outside said furnace.

5. Electric furnace as claimed in claim 1, which is associated with a dismantling tool consisting of a frame (24) provided with an assembly of members (25, 26) for hooking a said panel (6), said members comprising two hooking assemblies (25, 26) symmetrical in relation to an axis of rotation and simultaneously carrying a panel (62) to be removed and a panel (61) to replace the removed panel (62) by rotation about its axis.

* * * * *